US011047211B2

(12) United States Patent
Rahman et al.

(10) Patent No.: US 11,047,211 B2
(45) Date of Patent: Jun. 29, 2021

(54) REVERSE CIRCULATION DEBRIS REMOVAL TOOL FOR SETTING ISOLATION SEAL ASSEMBLY

(71) Applicant: Halliburton Energy Services, Inc., Houston, TX (US)

(72) Inventors: Jameel U. Rahman, Spring, TX (US); Danny P. Lewis, Lake Charles, LA (US); Colby M. Ross, Carrollton, TX (US); Peter R. Maher, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/577,031

(22) PCT Filed: Oct. 7, 2016

(86) PCT No.: PCT/US2016/056130

§ 371 (c)(1),
(2) Date: Nov. 27, 2017

(87) PCT Pub. No.: WO2018/067182

PCT Pub. Date: Apr. 12, 2018

(65) Prior Publication Data

US 2019/0226301 A1 Jul. 25, 2019

(51) Int. Cl.
*E21B 23/02* (2006.01)
*E21B 37/08* (2006.01)
(Continued)

(52) U.S. Cl.
CPC ..... *E21B 37/08* (2013.01); *E21B 23/02* (2013.01); *E21B 33/129* (2013.01); *E21B 37/00* (2013.01); *E21B 2200/06* (2020.05)

(58) Field of Classification Search
CPC ..... E21B 23/01; E21B 23/02; E21B 23/08; E21B 23/10
See application file for complete search history.

(56) References Cited

U.S. PATENT DOCUMENTS 2,392,244 A * 1/1946 Hooser ..... E21B 23/02 166/125
3,002,565 A * 10/1961 Moore, Jr. ..... E21B 23/02 166/217
(Continued)

FOREIGN PATENT DOCUMENTS

EP 2149671 A2 2/2010
GB 2374621 A 10/2002
(Continued)

OTHER PUBLICATIONS

Dictionary definition of "perforation", accessed Jun. 7, 2020 via thefreedictionary.com.*
(Continued)

*Primary Examiner* — Blake E Michener
(74) *Attorney, Agent, or Firm* — Haynes and Boone, LLP

(57) ABSTRACT

A system and method for deployment of an isolation seal assembly wherein an isolation seal assembly is releasably attached to a reverse circulation debris removal tool. The system includes a debris removal tool having a head with an elongated snorkel extending from the head; and an isolation seal assembly attached to the head with a shear device so that the snorkel protrudes past the end of the isolation seal assembly. The isolation seal assembly further includes a tubular with a latch adjacent a first end, an external seal below the latch, and openings formed along tubular between latch and the seal. The debris removal tool is used to engage the isolation seal assembly with a lower completion assembly. The openings in the isolation seal assembly permit the
(Continued)

debris removal tool to continue to function after the isolation seal assembly is engaged with the lower completion assembly.

16 Claims, 8 Drawing Sheets

(51) Int. Cl.
*E21B 37/00* (2006.01)
*E21B 33/129* (2006.01)

(56) References Cited

U.S. PATENT DOCUMENTS 3,130,788 A * 4/1964 Cochran ..... E21B 23/02 166/217
3,593,784 A * 7/1971 Brown ..... E21B 23/02 166/145
3,856,081 A * 12/1974 Canalizo ..... E21B 33/1208 166/123
3,921,719 A * 11/1975 McCollum ..... E21B 21/16 166/386
4,479,539 A * 10/1984 Tamplen ..... E21B 23/02 166/212
4,494,608 A * 1/1985 Williams ..... E21B 23/08 137/70
4,513,817 A 4/1985 Weinberg
4,516,917 A * 5/1985 Canalizo ..... E21B 17/06 166/318
4,896,721 A * 1/1990 Welch ..... E21B 23/02 166/214
5,433,275 A 7/1995 Melenyzer et al.
5,865,251 A 2/1999 Rebardi et al.
6,167,970 B1 * 1/2001 Stout ..... E21B 23/04 166/151
6,640,897 B1 * 11/2003 Misselbrook ..... E21B 17/06 166/278
2001/0017208 A1 8/2001 Martin
2003/0079882 A1 * 5/2003 Mack ..... E21B 43/121 166/369
2012/0168178 A1 * 7/2012 Eriksen ..... E21B 23/04 166/382
2013/0062066 A1 3/2013 Broussard et al.
2013/0206402 A1 * 8/2013 Coon ..... E21B 43/14 166/255.1
2013/0255946 A1 10/2013 Frisby et al.

FOREIGN PATENT DOCUMENTS

WO WO 1999/031352 A2 6/1999
WO WO 2004/072437 A1 8/2004
WO WO 2005/103440 A2 11/2005
WO WO 2006/131339 A1 12/2006
WO WO 2014/066238 A1 5/2014

OTHER PUBLICATIONS

International Search Report and the Written Opinion of the International Search Authority, or the Declaration, dated Jun. 20, 2017, PCT/US2016/056130, 17 pages, ISA/KR.
Laidlaw, et al. "Combination of Dual String Single Trip Multi-Zone Completion Systems and High Rate Formation Pack as a Proven Completion Methodology for an Unconsolidated Reservoir: Case Study Tunu Field," SPE Oil and Gas India Conference and Exhibition, Mar. 28-30, 2012,Mumbai.
Lougheide, et al. "Trinidad's First Multilateral Well Successfully Integrates Horizontal Openhole Gravel Packs," Offshore Technology Conference, May 3-6, 2004, May, Houston, Texas.
First Non-Final Office Action issued by the Azerbaijanian Patent Office for Patent Application No. a20190036 dated Feb. 21, 2020, 2 pages.

* cited by examiner

REVERSE CIRCULATION DEBRIS REMOVAL TOOL FOR SETTING ISOLATION SEAL ASSEMBLY

PRIORITY

The present application is a U.S. National Stage patent application of International Patent Application No. PCT/US2016/056130, filed on Oct. 7, 2016, the benefit of which is claimed and the disclosure of which is incorporated herein by reference in its entirety.

TECHNICAL FIELD

The present disclosure generally relates to oilfield equipment and, in particular, to installation of completion equipment once a wellbore has been drilled. More particularly still, the present disclosure relates to systems and methods for removing debris accumulated about lower completion equipment while at the same time installing upper completion equipment.

BACKGROUND

After drilling the various sections of a subterranean wellbore that traverses a formation, a completion assembly is often installed to enhance and optimize production of hydrocarbons from the wellbore. Generally, completion assemblies may include sealing elements, mechanical filtering elements and flow control elements. More particularly, completion assemblies often comprise both a lower completion assembly and an upper completion assembly. Typically, the lower completion assembly is installed and used to isolate and control production zones, in the lower portion of the wellbore from upper portions of the wellbore. At the upper end of the lower completion assembly, above the lower completion assembly's isolation barrier valve, is a closing sleeve and packer assembly. Following installation of the lower completion assembly, an isolation seal assembly is run-in and installed to isolate the closing sleeve and to enable the lower completion assembly to be engaged by the upper completion assembly. Finally, an upper completion assembly is run-in and engaged with the lower completion assembly. The upper completion assembly often includes a production packer, fluid monitoring and control devices and a safety valve barrier assembly.

Following installation of the lower completion assembly but prior to run-in of the isolation seal assembly, one practice is to run in debris extraction equipment into the wellbore to remove gravel, sands, shavings and other debris that may have accumulated in the wellbore above the top of the lower completion assembly. Such debris extraction equipment may include tubing with fluid jets that vent into the wellbore annulus to create a reverse circulation flow that results in a low pressure suction to pull debris into the inner annulus of the tubing. It is highly desirable to clean the upper end of the lower completion assembly in order to ensure that debris does not interfere with engagement of the isolation seal assembly to the lower completion assembly or engagement of the upper completion assembly to the isolation seal assembly. Thus, in order to most effectively install an upper completion assembly in a wellbore, multiple trips into the wellbore are required.

DESCRIPTION OF ILLUSTRATIVE EMBODIMENTS

Figure 1:
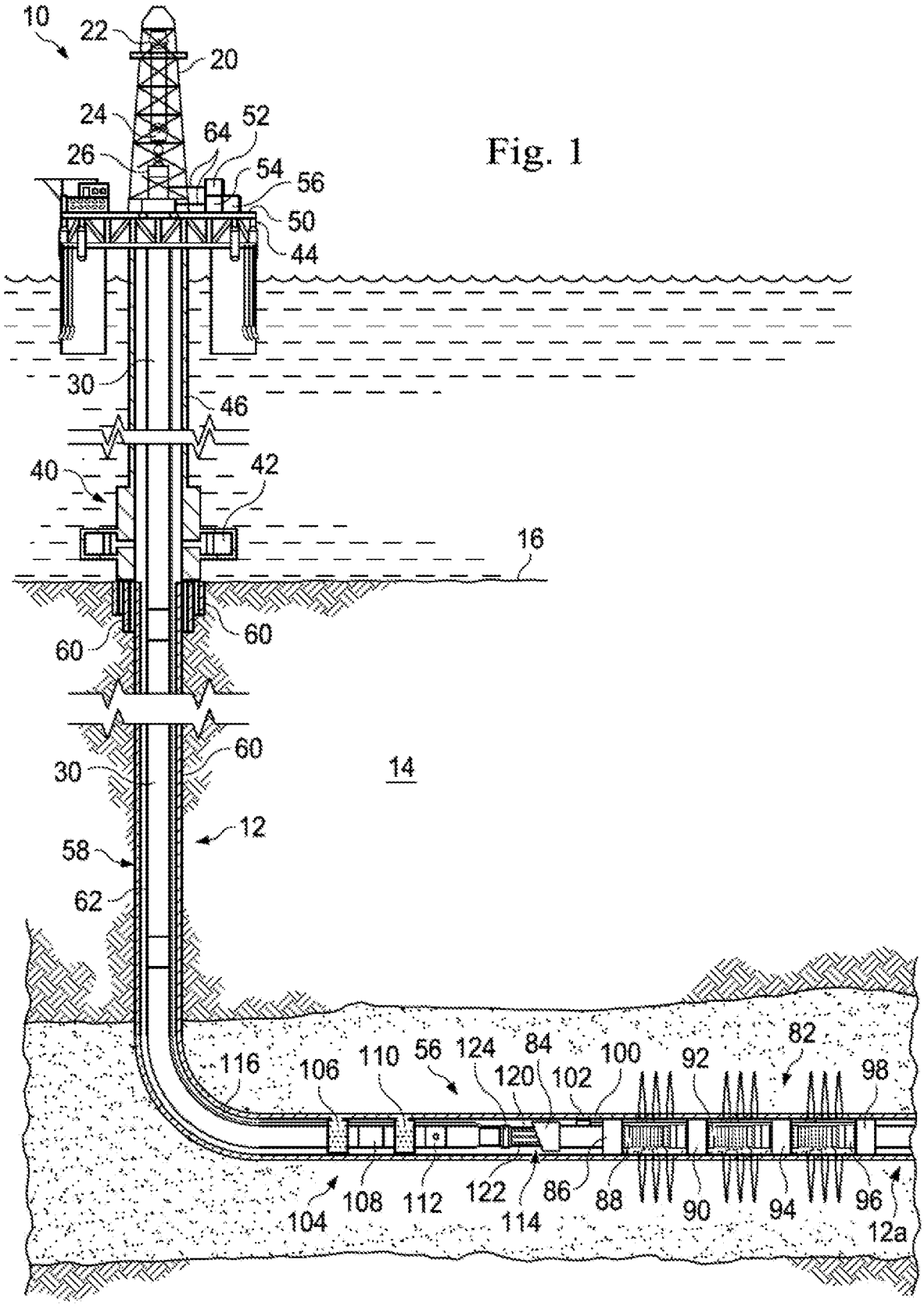
FIG. 1 depicts an offshore well completion system having an isolation seal assembly installed using reverse circulation debris removal tool, according to one or more illustrative embodiments.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a figure may depict a horizontal wellbore or a vertical wellbore, unless indicated otherwise, it should be understood by those skilled in the art that the apparatus according to the present disclosure is equally well-suited for use in wellbores having other orientations including, deviated wellbores, multilateral wellbores, or the like. Likewise, unless otherwise noted, even though a figure may depict an offshore operation, it should be understood by those skilled in the art that the apparatus according to the present disclosure is equally well-suited for use in onshore operations and vice-versa.

Generally, illustrative embodiments and related methods are described below as they might be employed in an anchor assembly, such as an isolation seal assembly, that may be carried by a debris removal tool during run in of the debris removal tool. The isolation seal assembly generally includes an elongated tubular with a first end and a second with a releasable engagement mechanism at the first end for releasably securing the isolation seal assembly to a debris removal tool. A first set of seals are externally mounted along the tubular. Perforations or slots are provided along the elongated tubular between the engagement mechanism and the first set of seals. A latch mechanism may be provided adjacent the first end of the tubular for engaging the lower end of an upper completion string. Another latch mechanism may be provided between the first set of seals and the perforations for engaging the upper end of a lower completion string. A second set of seals may be externally mounted along the tubular adjacent the second end of the tubular. The engagement mechanism and the latch mechanism adjacent the first end may be the same. The isolation seal assembly is attached to a debris removal tool and thus, can be run-in and set at the same time the debris removal tool is run-in. In one or more embodiments, when the isolation seal assembly is secured to the debris removal tool by the engagement mechanism, the snorkel of the debris removal tool extends beyond the second end of the elongated tubular of the isolation seal assembly to allow operation of the debris removal tool while the isolation seal assembly is attached. The system can be run-in until the lower latch mechanism engages the lower completion assembly. Application of a release force may then be used to separate the debris removal tool from the isolation seal assembly, permitting continued cleaning and thereafter, removal of the debris removal tool.

Turning to FIG. 1, shown is an elevation view in partial cross-section of a wellbore completion system 10 utilized to complete wells intended to produce hydrocarbons from wellbore 12 extending through various earth strata in an oil and gas formation 14 located below the earth's surface 16. Wellbore 12 may be formed of a single or multiple bores, extending into the formation 14, and disposed in any orientation, such as the horizontal wellbore 12*a* illustrated in FIG. 1.

Completion system 10 includes a rig or derrick 20. Rig 20 may include a hoisting apparatus 22, a travel block 24, and a swivel 26 for raising and lowering casing, drill pipe, coiled tubing, production tubing, other types of pipe or tubing strings or other types of conveyance vehicles such as wireline, slickline, and the like 30. In FIG. 1, conveyance vehicle 30 is a substantially tubular, axially extending work string or production casing, formed of a plurality of pipe joints coupled together end-to-end supporting a completion assembly as described below.

Rig 20 may be located proximate to or spaced apart from wellhead 40, such as in the case of an offshore arrangement as shown in FIG. 1. One or more pressure control devices 42, such as blowout preventers (BOPs) and other equipment associated with drilling or producing a wellbore may also be provided at wellhead 40 or elsewhere in the system 10.

For offshore operations, as shown in FIG. 1, rig 20 may be mounted on an oil or gas platform 44, such as the offshore platform as illustrated, semi-submersibles, drill ships, and the like (not shown). Although system 10 of FIG. 1 is illustrated as being a marine-based completion system, system 10 of FIG. 1 may be deployed on land. In any event, for marine-based systems, one or more subsea conduits or risers 46 extend from deck 50 of platform 44 to a subsea wellhead 40. Tubing string 30 extends down from rig 20, through subsea conduit 46 and BOP 42 into wellbore 12.

A working or service fluid source 52, such as a storage tank or vessel, may supply, via flow lines 64, a working fluid 54 (see FIGS. 5A and 5B) pumped to the upper end of tubing string 30 and flow through tubing string 30 to equipment disposed in wellbore 12, such as subsurface equipment 56. Working fluid source 52 may supply any fluid utilized in wellbore operations, including without limitation, drilling fluid, cement slurry, acidizing fluid, liquid water, steam or some other type of fluid.

Completion system 10 may generally be characterized as having a pipe system 58. For purposes of this disclosure, pipe system 58 may include casing, risers, tubing, drill strings, completion or production strings, subs, heads or any other pipes, tubes or equipment that couples or attaches to the foregoing, such as string 30, conduit 46, collars, and joints, as well as the wellbore 12 and laterals in which the pipes, casing and strings may be deployed. In this regard, pipe system 58 may include one or more casing strings 60 that may be cemented in wellbore 12, such as the surface, intermediate and production casings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

Fluids, cuttings and other debris returning to surface 16 from wellbore 12 are directed by a flow line 64 to storage tanks 54 and/or processing systems 66, such as shakers, centrifuges and the like.

As shown in FIG. 1, subsurface equipment 56 is illustrated as completion equipment and tubing string 30 in fluid communication with the completion equipment 56 is illustrated as production tubing 30. Although completion equipment 56 can be disposed in a wellbore 12 of any orientation, for purposes of illustration, completion equipment 56 is shown disposed in a substantially horizontal portion of wellbore 12 and includes a lower completion assembly 82 having various tools such as an orientation and alignment subassembly 84, a packer 86, a sand control screen assembly 88, a packer 90, a sand control screen assembly 92, a packer 94, a sand control screen assembly 96 and a packer 98.

Extending downhole from lower completion assembly 82 is one or more control lines 100, that pass through packers 86, 90, 94 and may be operably associated with one or more devices 102 associated with lower completion assembly 82. Control lines 100 may include hydraulic lines, electric lines, optic lines, etc. Where control lines are electric or optic lines, such as cable devices 102 may be electric or optic devices, such as sensors, positioned dowhnole. Devices 102 may be controllers or actuators used to operate downhole tools or fluid flow control devices. Cable 100 may operate as communication media, to transmit power, or data and the like between lower completion assembly 82 and an upper completion assembly 104. Data and other information may be communicated using electrical signals, optic signals acoustic signals or other telemetry that can be converted to electrical signals at the rig 20 to, among other things, monitor the conditions of the environment and various tools in lower completion assembly 82 or other tool string.

In this regard, disposed in wellbore 12 at the lower end of tubing string 30 is an upper completion assembly 104 that includes various tools such as a packer 106, an expansion joint 108, a packer 110, a fluid flow control module 112. Additional completion equipment 114 is also illustrated in FIG. 1. In one or more embodiments, this additional completion equipment 114 may be a component of or otherwise form part of lower completion assembly 82 or upper completion assembly 104. In FIG. 1, and generally throughout the description, additional completion equipment 114 may be referred to as an anchor assembly 114, or as an isolation tool assembly 114, but need not be limited to the specific descriptions os such. In any event, as shown in FIG. 1, additional completion equipment 114 is an anchor assembly 114 that generally secures upper completion assembly 104 to lower completion assembly 82. In one or more embodiments, to the extent lower completion assembly 82 includes a closing sleeve (not shown), anchor assembly 114 may be or include an isolation seal assembly.

Extending uphole from upper completion assembly 104 are one or more control lines 116, such as hydraulic tubing, sensor cable or electric cable, which extends to the surface 16. Cable 116 may operate as communication media, to transmit power, signals or data and the like between a surface controller (not shown) and the upper and lower completion assemblies 104, 82, respectively.

With respect to anchor assembly 114, the anchor assembly 114 includes openings 120, such as apertures, perforations or slots, along a portion of the tubular 122 forming anchor assembly 114. Anchor assembly 114 may further include a latch mechanism 124 for engagement with upper completion assembly 104.

Figure 2:
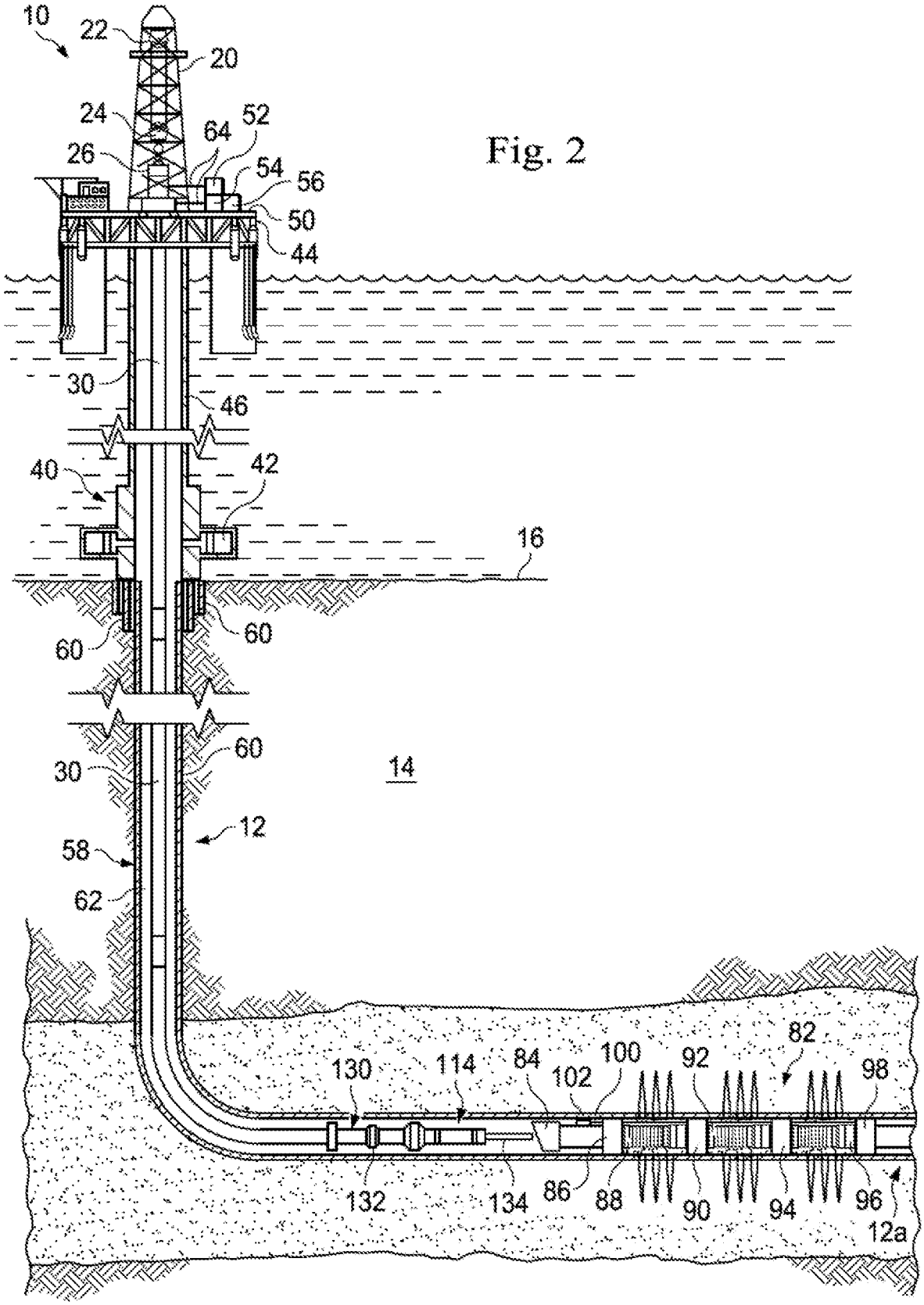
FIG. 2 depicts a reverse circulation debris removal tool during installation of the isolation seal assembly of FIG. 1, according to one or more illustrative embodiments.

FIG. 2 illustrates the wellbore 12 of FIG. 1 with a lower completion assembly 82 deployed therein, but without the upper completion assembly 104 of FIG. 1. Rather, a debris removal tool 130 is illustrated as it is being lowered on a tubing string 30 into wellbore 12 towards lower completion assembly 82. Secured to debris removal tool 130 is anchor assembly 114. Although debris removal tool 130 need not be limited to a particular type of debris removal tool, in some embodiments debris removal tool is a reverse circulation debris removal tool 130 and will generally be described as such herein. In this regard, as shown, debris removal tool 130 generally includes a head 132 from which a snorkel 134 extends.

Figure 3:
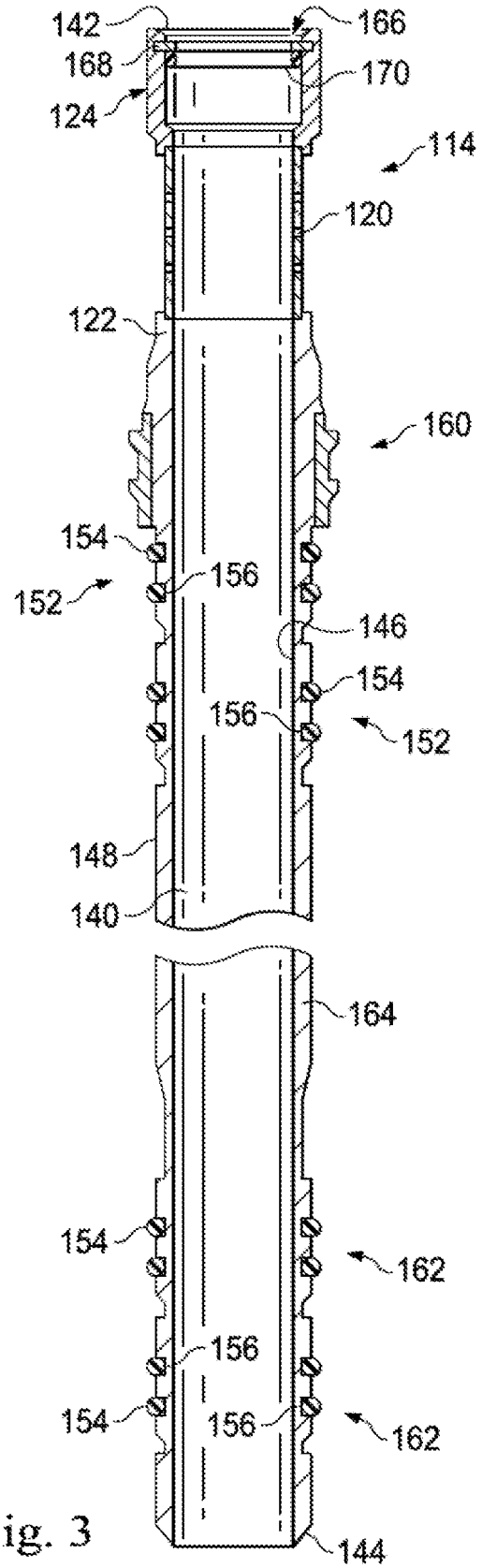
FIG. 3 depicts an isolation seal assembly, according to certain illustrative embodiments of the present disclosure.

Turning to FIG. 3, anchor assembly 114 is illustrated in more detail. Anchor assembly 114 is generally formed of a sub or tubular 122 having a through bore 140 extending between a first end 142 and a second end 144, the tubular 122 having an inner tubular surface 146 and an outer tubular surface 148. A first latch mechanism 124 is disposed on tubular 122 adjacent first end 142. A first seal assembly 152 is positioned along outer tubular surface 148 between first latch mechanism 124 and second end 144 of tubular 122. Although seal assembly 152 is not limited to a particular type of seal, in one or more embodiments, seal assembly 152 may be an elastomeric element(s) 154 seated in a recess(es) 156 formed in surface 148, while in other embodiments, seal assembly 152 may include an expandable elastomeric element. One or more perforations or slots 120 are formed along tubular 122 between first latch mechanism 124 and first seal assembly 152, and extend from inner surface 146 to outer surface 148. In one or more embodiments, a second latch mechanism 160 may be positioned along tubular 122 between perforations 120 and second end 144. In embodiments where anchor assembly 114 is to function as an isolation seal assembly, such as is shown in FIG. 4 below, anchor assembly 114 may further include a second seal assembly 162 positioned along outer tubular surface 148 between first seal assembly 152 and second end 144 of tubular 122. In one or more embodiments of an isolation seal assembly, tubular 122 may include an elongated tubular portion 164 between the first and second seal assemblies 152, 162, with second seal assembly 162 positioned adjacent second end 144 of tubular 122. Anchor assembly 114 may also include a releasable engagement mechanism 166 adjacent first end 142 of tubular 122. In one or more embodiments, engagement mechanism 166 may be a shear mechanism 168, such as a shear ring, shear bolt or shear pins. In other embodiments, first latch mechanism 124 may form engagement mechanism 166. Finally, a seal 170 may be positioned along inner surface 146 of tubular 122 adjacent engagement mechanism 166.

Figure 4A:
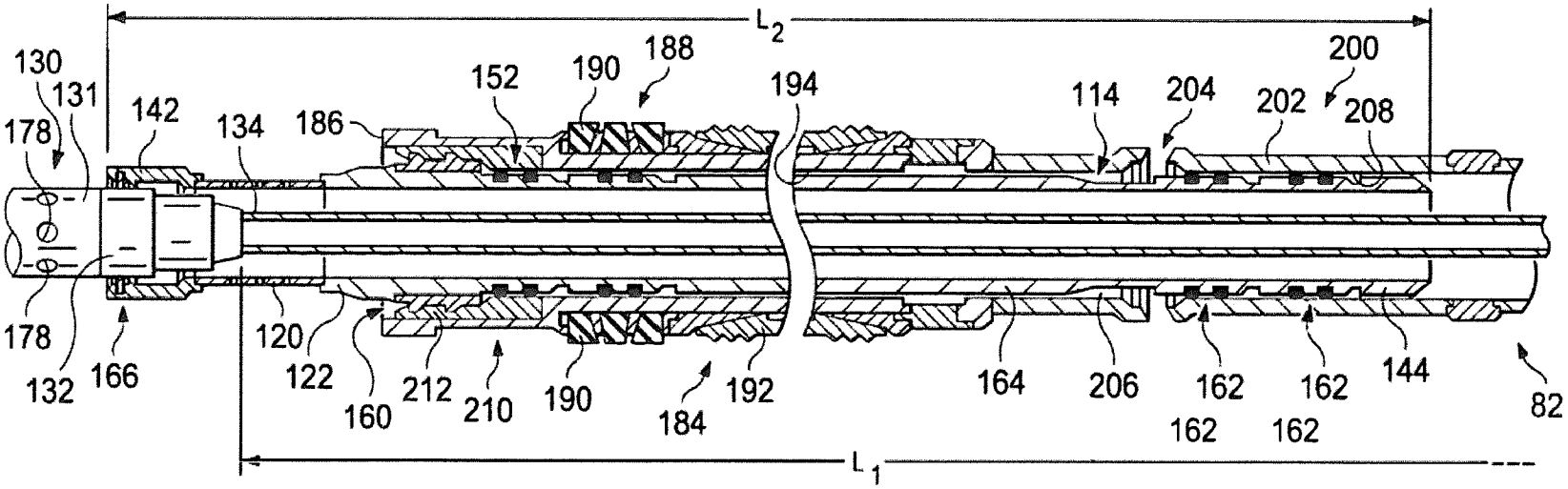
FIGS. 4A-4B depict an isolation seal assembly carried by a debris removal tool and engaged with a lower completion assembly, according to certain illustrative embodiments of the present disclosure.
Figure 4B:
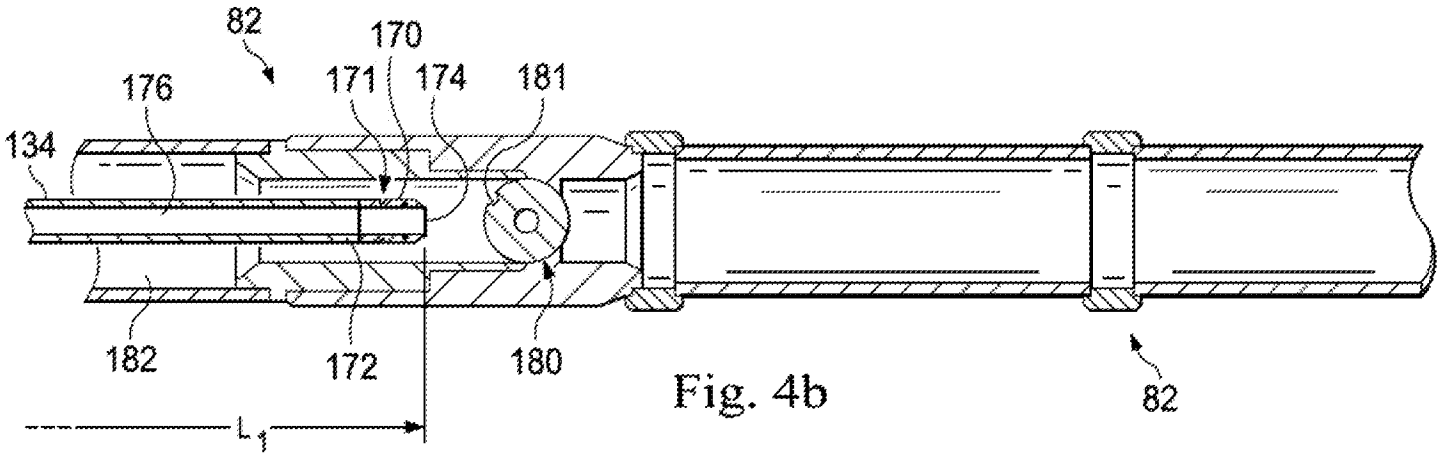

With reference to FIGS. 4*a* and 4*b*, the anchor assembly 114 of FIG. 3 is shown attached to a reverse circulation debris removal tool 130 and engaging the upper end of a lower completion assembly 82. Debris removal tool 130 generally includes a tool sub 131 having a head 132 from which a snorkel 134 extends. A suction tip 170 is disposed at the distal end 172 of snorkel 134 with an opening 174 into the interior 176 of snorkel 134. As shown, when anchor assembly 114 is attached to debris removal tool 130, snorkel 134 extends beyond the second end 144 of anchor assembly 114. Sub 131 may also include one or more jet nozzles 178 that vent a working fluid 54 (see FIGS. 5A and 5B) from an interior flow passage (not shown) of the tool 130 to the exterior of the tool 130 so that conventional circulation from the surface can be used to induce a reverse circulation loop from the top of the tool to the bottom of the string, creating a low pressure within tool 130 and causing a high velocity, reverse circulation flow effect at the suction tip 174 of snorkel 134. In preferred embodiments, the length $L_1$ of the snorkel 134 is selected so that the snorkel 134 extends past the second end 144 of tubular 122 of anchor assembly 114. Thus, in some embodiments, the length $L_1$ of the snorkel 134 is longer than the length $L_2$ of anchor assembly 114.

Although the anchor assembly 114 described herein is not intended to be limited by the particular configuration of lower completion assembly 82 with which it may be used, in one or more embodiments, lower completion assembly 82 may generally include an isolation barrier valve assembly 180 disposed along an internal flowpath 182 of the lower completion assembly 82 for selective opening and closing of the isolation barrier valve assembly 180 and control of fluid flow along flow path 182. Likewise, lower completion assembly 82 may include a packer assembly 184 deployed between the isolation barrier valve assembly 180 and an end 186 of lower completion assembly 82. Packer assembly 184 may include a packer sub 188 on which is mounted one or more elastomeric sealing elements 190 and one or more slips 192. Finally, packer assembly 184 may include a bore 192 defined therein, at least a portion of which defines a sealing surface 194 for receipt of seals 152 of anchor assembly 114.

In one more embodiments, such as is illustrated, lower completion assembly 82 includes a closing sleeve 200 disposed between the isolation valve 180 and the packer assembly 184. Closing sleeve 200 generally is formed of an elongated tubular 202 having one or more ports 204 defined therein. Tubular 202 include a bore 206 defined therein, at least a portion of which defines a sealing surface 208 for engagement with seals 162 of anchor assembly 114. As illustrated, when anchor assembly 114 is deployed in lower completion assembly 82 (particularly when latch mechanism 160 is engaged with latch sub 210 as described below), first and second seal assemblies 152, 162 are positioned above and below ports 204 of closing sleeve 200 so as to seal ports 204 form communication with flow path 182.

A latch sub 210 may be positioned adjacent packer assembly 184 or otherwise integrally formed therewith. Latch sub 210 includes a latch 212 for engagement with latch mechanism 160 of anchor assembly 114 to permit anchor assembly 114 to be axially and/or radially fixed to lower completion assembly 82. It will be appreciated that while a latch sub 210 and latch mechanism 160 are illustrated, in other embodiments, these components may be eliminated. Rather, anchor assembly 114 may be allowed to move or "float" relative to lower completion assembly 82 so long as seal assemblies 152, 162 seal flow path 182 from fluid communication with annulus 62 (see FIG. 1).

In any event, engagement mechanism 166 is releasably attached to head 132 of debris removal tool 130. Engagement mechanism 166 permits anchor assembly 114 to be secured to debris removal tool 130 during run-in and for purposes of engaging anchor assembly 114 with lower completion assembly 82, but then selectively detached from debris removal tool 130. For example, it will be appreciated that once latch mechanism 160 engages latch 212, an axial or rotational shearing force may be applied to shear mechanism 166 through debris removal tool 130, causing shear mechanism 166 to shear, thereby releasing debris removal tool 130 from anchor assembly 114. In other embodiments where a latch sub 210 and/or latch mechanism 160 are not provided and anchor assembly 114 is allowed to float within lower completion assembly 82, it will be appreciated that other manipulation may be employed to release engagement mechanism 166 from head 132 of debris removal tool 130. For example, suction tip 170 may be advanced until it seats against isolation barrier valve assembly 180, after which, a continued downward axial force on debris removal tool 130 will cause shearing of shear element 168 (see FIG. 3) and thus release of anchor assembly 114 from debris removal tool 130.

In one or more embodiments, the distal end 172 of snorkel 134 may include a shift profile 171 disposed for engagement with a shift profile 181 of valve 180. If needed, these shift profiles 171, 181 may be located and engaged to operate the barrier value 180 mechanically using axial force prior to retrieval of the debris removal tool 130.

Figure 5A:
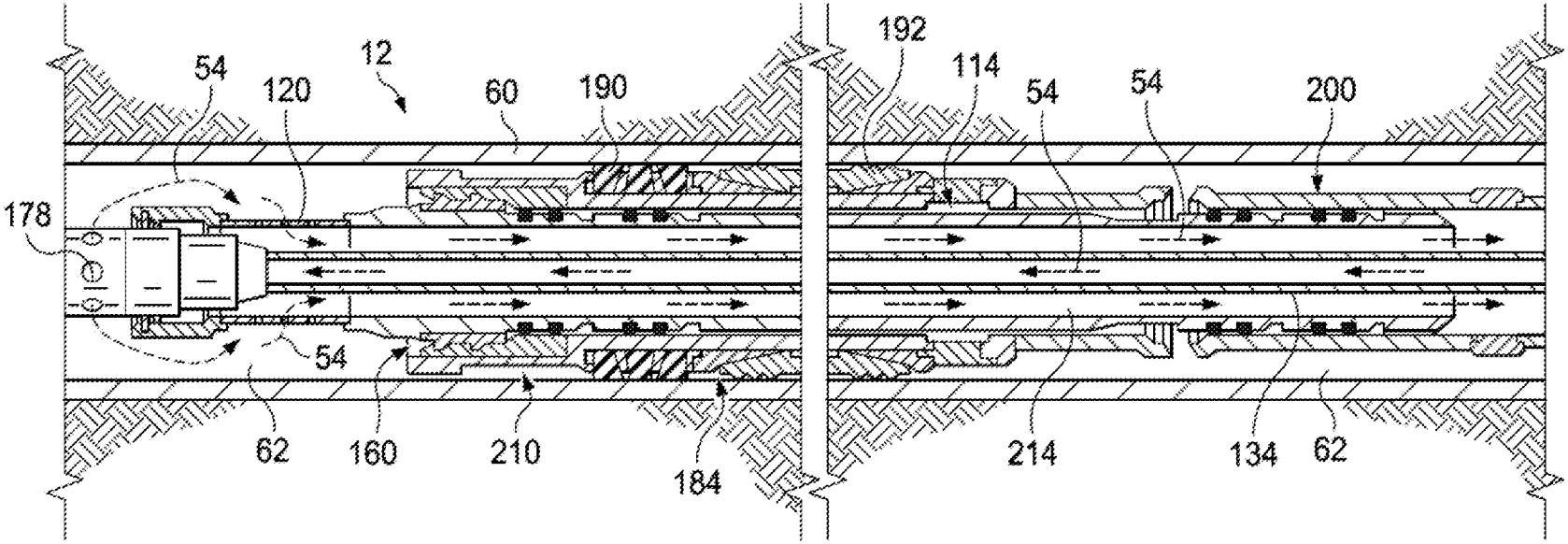
FIGS. 5A-5B depicts working fluid flow during debris removal utilizing the assembly of FIG. 5, according to certain illustrative embodiments of the present disclosure.
Figure 5B:
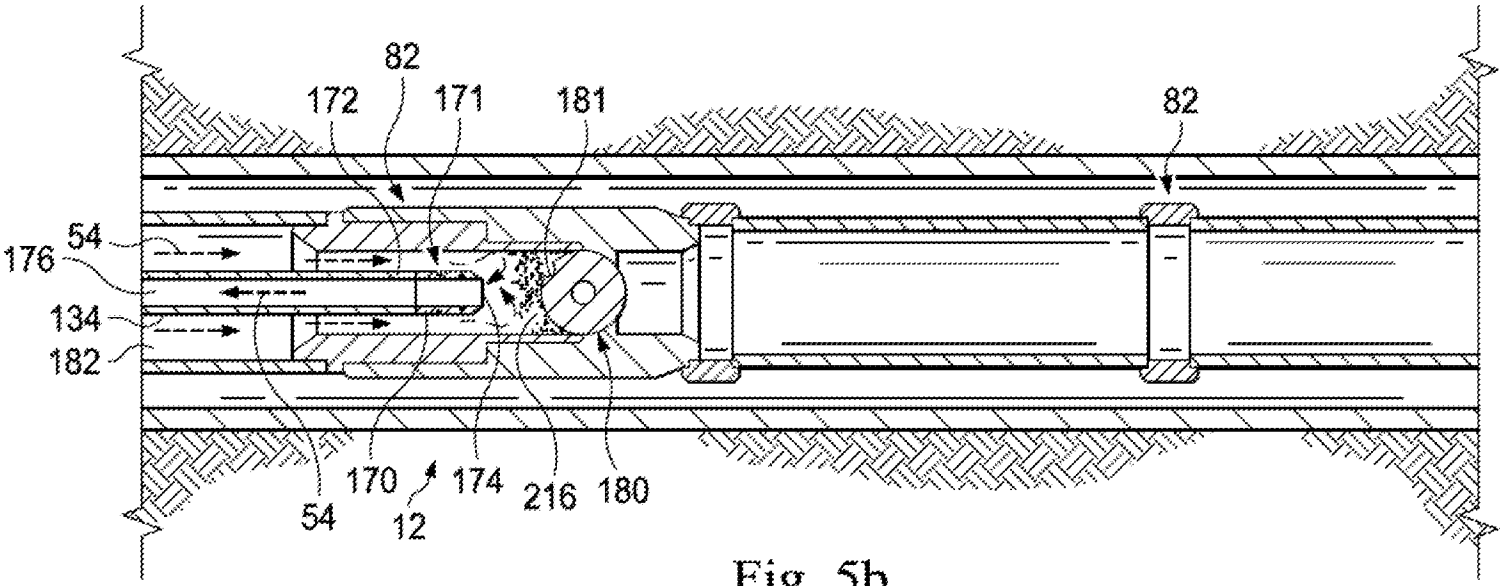

FIGS. 5*a* and 5*b* illustrates the anchor assembly 114, debris removal tool 130 and lower completion assembly 82 of FIG. 4, but deployed in a wellbore 12. In particular, the anchor assembly 114 carried by debris removal tool 130 is stabbed into or otherwise engaged with the lower completion assembly 82 so that the through bore 140 of the isolation seal assembly 114 is in fluid communication with the flow path 182 of the lower completion assembly 82. In such case, FIG. 5 illustrates the flow of high velocity fluid 54 as it travels from the jets 178 of debris removal tool 130, through the openings or slots 120 of anchor assembly 114, and into the interior of anchor assembly 114. As shown, the flow of fluid 54 is directed into the annulus 214 between the snorkel 134 of debris removal tool 130 and the inner tubular surface 146 of anchor assembly 114, thereby allowing flow to continue down suction tip 170 and circulate back into snorkel 134, causing a low pressure condition within snorkel 134. Debris 216 accumulated in lower completion assembly 82, and in particular on or about the valve 180, is sucked up by the fluid and low pressure condition of snorkel 134 through the opening 174.

Although additional completion equipment 114 has been illustrated primarily as an anchor assembly 114, or as an isolation tool assembly 114, additional completion equipment 114 may be any component of or otherwise form part of either the lower completion assembly 82 or upper completion assembly 104 shown in FIG. 1 so long as the additional completion equipment can be releasably attached to debris removal tool 130 for transport into a wellbore 12 as described herein. Thus, in this regard, additional completion equipment 114 need only include an engagement mechanism 166, such as a shear mechanism, latch mechanism, or similar attachment mechanism, to permit the additional completion equipment 114 to be temporarily secured to the debris removal tool 130.

Figure 6:
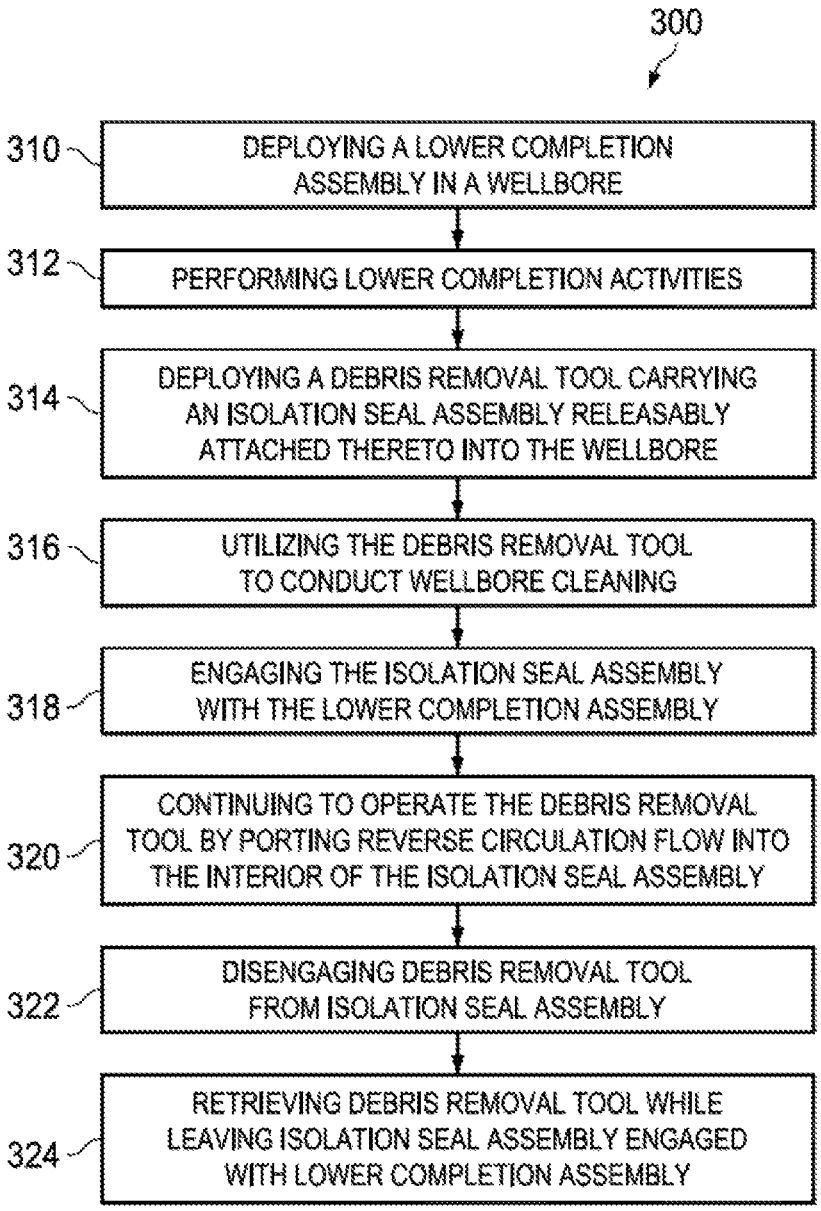
FIG. 6 is a method for deploying an isolation seal assembly utilizing a reverse circulation debris removal tool, according to certain illustrative embodiments of the present disclosure.

With reference to FIG. 6, the operation 300 of the above described systems will be discussed. As generally described, the system is utilized in conjunction with a lower completion assembly 82 that has been deployed in a wellbore 12. Thus, initially, a lower completion assembly 82 is deployed in a wellbore 12. As part of the deployment, anchor mechanisms 192 of the lower completion assembly 82 may be set to secure the lower completion assembly 82 within the wellbore 12. Likewise, sealing elements 190 may be actuated to seal the annulus 62 around the lower completion assembly 84. Thus, in a first step 310, a lower completion assembly 82 is deployed and secured within a wellbore 12. The wellbore 12 may be cased or open hole. The completion assembly 82 may include one or more slips 192 and packers 190 that may be actuated to isolate screens adjacent various production zones. Thus, as part of the deployment, slips, such as slips 192, may be set to secure various components of the lower completion assembly 82 within wellbore 12, and packers may be actuated to seal the annulus 62 at various locations along the lower completion assembly 82.

In step 312, various lower completion activities may be performed. For example, gravel packing may performed. Likewise, flowback may be performed. In case of flowback, an isolation valve 180 may be closed and a closing sleeve 200 may be opened to permit fluid communication between a flowpath 182 within the lower completion assembly 84 and the wellbore annulus 62. It will be appreciated that during these various activities, gravel, sands, shavings and other debris may collect within the lower completion assembly 82, particularly adjacent the closed isolation valve 180.

Once the various activities have been completed, in step 314, a debris removal tool 130 is deployed in the wellbore 12. The debris removal tool 130 includes additional completion equipment 114 removably attached to the debris removal tool 130, and thus, the debris removal tool 130 is utilized to transport the additional completion equipment 114 into the wellbore 12. The additional completion equipment 114 is secured to the debris removal tool 130 in such a way that the operation of the debris removal tool 130 is not inhibited, and thus, can be utilized to continue to conduct debris removal activities even with the additional completion equipment 114 attached. Thus, where the debris removal tool 130 includes a snorkel 134 or similar extension, the snorkel may extend beyond the second end 144 of the additional completion equipment 114. In one or more embodiments, the debris removal tool 130 utilizes reverse circulation to vacuum debris and the additional completion equipment 114 is an anchor assembly 114. In such case, the snorkel 134 of the debris removal tool 130 extends through the anchor assembly 114 and beyond the second end 144 of the anchor assembly 114. In any event, the debris removal tool 130 is advanced to a location in the wellbore 12 that is in proximity to the lower completion assembly 82, or otherwise to a point where it is desired to begin removal of debris.

In step 316, the debris removal tool 130 is actuated, operated and utilized to remove accumulated gravel, sands, shavings and other debris as the debris removal tool 130 is moved into the vicinity of the lower completion assembly 82. In embodiments utilizing reverse circulation for these wellbore cleaning operations, a pressurized working fluid 54 is pumped down to the debris removal tool 130 and released by jets 178 into the wellbore annulus 62 surrounding the debris removal tool 130. The jetted fluid flow creates a low pressure condition within the debris removal tool 130 and high velocity flow along the exterior of the debris removal tool 130, causing reverse circulation flow at the tip 170 of the debris removal tool 130.

In step 318, the anchor assembly 114 is stabbed into the lower completion assembly 82. In embodiments of the system that include a latch mechanism 160 carried by the anchor assembly 114 and a corresponding latch sub 210 on the lower completion assembly 84, the debris removal tool 130 is advanced until the latch mechanism 160 of the anchor assembly 114 engages the latch sub 210 of the lower completion assembly 82, thereby locking or otherwise securing the anchor assembly 114 to the lower completion assembly 82. In alternative embodiments, the anchor assembly 114 and the lower completion assembly 82 may include shoulders (not shown) that engage one another for relative positioning of the anchor assembly 114. In any event, it will be appreciated that in the foregoing embodiments, the length $L_1$ of the of the snorkel 134 may be selected so that when the anchor assembly 114 is secured or engaged by the lower completion assembly 82, the snorkel tip 170 is spaced apart a desired distance from the isolation valve 180, thereby mitigating against damage to the isolation valve 180 by the snorkel 134. In embodiments of the system where a latch mechanism 160 and latch sub 210 (or shoulders) are not present, then the anchor assembly 114 may simply be stabbed into the lower completion assembly 82 and allowed to "float" relative to the lower completion assembly 82. In either case, external seals 152, 162 carried on the anchor assembly 114 seal against the adjacent walls surfaces 194, 208 of the lower completion assembly 82.

It will be appreciated that because of seals 152, 162 between the lower completion assembly 82 and the anchor assembly 114, the reverse circulation flow of the debris removal tool 130 would be inhibited once anchor assembly 114 is engaged with lower completion assembly 82. However, the presence of perforations or slots 120 permit the reverse circulation flow of debris removal tool 130 to continue. Thus, in step 320, the high velocity flow emanating from the debris removal tool 130 is ported or otherwise directed by perforations 120 into the interior of the anchor assembly 114 and along the annulus 214 between the anchor assembly 114 and the snorkel 134 of the debris removal tool 130. Because of the low pressure condition within the debris removal tool 130, debris adjacent the distal end of the snorkel 134 is drawn or sucked into the snorkel 134 for removal.

In step 322, the debris removal tool 130 is disengaged from the anchor assembly 114. In one or more embodiments, an axial or rotational force is applied to the debris removal tool 130, causing the mechanism 166 securing the anchor assembly 114 to the debris removal tool 130 to shear, thereby separating the debris removal tool 130 from the anchor assembly 114. In other embodiments, axial and/or rotational forces may be applied to the debris removal tool 130 to cause an engagement mechanism 166 securing the debris removal tool 130 and to the anchor assembly 114 to disengage.

Once the debris removal tool 130 has been separated from the anchor assembly 114, the debris removal tool 130 may continue to be utilized to remove debris. For example, the debris removal tool 130 may be advanced farther into the wellbore 12 so that the suction tip 170 of the snorkel 134 is adjacent the valve 180. In this regard, the debris removal tool 130 may be used to toggle valve 80 in order to better remove debris from around valve 80.

Finally, it step 324, the debris removal tool is retrieved from the wellbore, leaving the anchor assembly engaged with the lower completion assembly 82 and in place for engagement with an upper completion assembly 104 or other wellbore equipment.

Thus, isolation seal assembly for use in a wellbore has been described. Embodiments of the isolation seal assembly may generally include a tubular with a first end and a second end and an outer tubular surface; a first latch mechanism disposed on tubular adjacent first end; a first seal assembly positioned along outer tubular surface between first latch mechanism and second end of tubular; and one or more openings formed along tubular between first latch mechanism and the first seal assembly. Similarly, a system for placement of an engagement mechanism in a wellbore has been described. Embodiments of the placement system may generally include a debris removal tool; and an isolation seal assembly releasably attached to the debris removal tool, the isolation seal assembly comprising a tubular having a through bore extending between a first end and a second end, the tubular also having an outer tubular surface; a first latch mechanism disposed on tubular adjacent first end; a first seal assembly positioned along outer tubular surface between first latch mechanism and second end of tubular; and one or more openings formed along tubular between first latch mechanism and the first seal assembly. Other embodiments of the placement system may generally include a debris removal tool; and completion equipment releasably attached to the debris removal tool.

For any of the foregoing embodiments, the apparatus may include any one of the following elements, alone or in combination with each other:

- A second latch mechanism positioned along tubular between openings and the second end.
- A second seal assembly positioned along outer tubular surface between first seal assembly and the second end of the tubular.
- The tubular includes an elongated portion between the first and second seal assemblies with the second seal assembly positioned adjacent the second end of tubular.
- A releasable engagement mechanism adjacent the first end of the tubular.
- The engagement mechanism comprises a shear element selected from the group consisting of a shear ring, a shear bolt and a shear pin.
- The first latch mechanism is a releasable engagement mechanism adjacent the first end of the tubular.
- A seal positioned along an inner surface of the tubular adjacent the engagement mechanism.
- A seal assembly comprises an elastomeric element seated in a recess formed in surface of the tubular.
- The openings extend from an inner surface of the tubular to the outer surface of the tubular.
- The debris removal tool comprises a sub having jet nozzles and a head from which an elongated snorkel extends, wherein the snorkel extends beyond the second end of the anchor assembly.
- The snorkel has a snorkel length and the anchor assembly has an anchor assembly length that is shorter than the snorkel length.
- A lower completion assembly having a packer assembly positioned at a first end of the lower completion assembly, a sand control screen spaced apart from the packer assembly; and an isolation valve disposed along a flow path defined in the lower completion assembly between the sand control screen and the packer assembly, wherein the isolation seal assembly is engaged with the lower completion assembly so that the through bore of the isolation seal assembly is in fluid communication with the flow path of the lower completion assembly.

The isolation seal assembly further comprises a second latch mechanism positioned along the tubular between the openings and the second end of the tubular; and the lower completion assembly comprises a latch sub positioned adjacent the packer assembly, wherein the second latch mechanism of the isolation seal assembly engages the latch sub of the lower completion assembly.

The lower completion assembly further comprises a closing sleeve disposed between the isolation valve and the packer assembly, wherein the closing sleeve has an elongated tubular with at least one port provided therein.

The isolation seal assembly further comprises a second seal assembly positioned along outer tubular surface between first seal assembly and the second end of the tubular, and wherein the isolation seal assembly engages the lower completion assembly so that the at least one port of the closing sleeve is positioned between the first and second seal assemblies, blocking the port from fluid communication with the flow path of the lower completion assembly.

A second latch mechanism positioned along tubular between openings and the second end; a releasable engagement mechanism adjacent the first end of the tubular, the engagement mechanism comprises a shear element selected from the group consisting of a shear ring, a shear bolt and a shear pin.

At least a portion of a lower completion assembly installed in a wellbore and spaced apart from the debris removal tool and completion equipment attached thereto, wherein the wherein the debris removal tool comprises a head and the completion equipment comprises a first end and a second end and an engagement mechanism adjacent the first end, the engagement mechanism securing the completion equipment to the head of the debris removal tool.

The debris removal tool further comprises an elongated snorkel extending from the head, wherein the snorkel extends beyond the second end of the completion equipment.

The snorkel has a snorkel length and the completion equipment has a completion equipment length that is shorter than the snorkel length.

Thus, a method for deploying completion equipment in a wellbore has been described. Embodiments of the deployment method include releasably attaching completion equipment to a reverse circulation debris removal tool; advancing the debris removal tool into a wellbore to a location in proximity to a lower completion assembly; initiating operation of the debris removal tool utilizing reverse circulation; engaging the completion equipment with the lower completion assembly; and continuing to operate the debris removal tool by porting reverse circulation flow into the interior of the completion equipment.

For the foregoing embodiments, the method may include any one of the following steps, alone or in combination with each other:

Applying a shearing force to the reverse circulation debris removal tool to separate the debris removal tool from the completion equipment; and withdrawing the debris removal tool from the wellbore while leaving the completion equipment engaged with the lower completion assembly.

Engaging comprises manipulating the debris removal tool so that a latch mechanism on the completion equipment attaches to a latch on the lower completion assembly so as to lock the completion equipment to the lower completion assembly.

Positioning the debris removal tool relative to the lower completion assembly so that flow through a closing sleeve is blocked.

Utilizing the debris removal tool to toggle an isolation valve once the debris removal tool has been separated from the completion equipment.

Utilizing the debris removal tool to toggle an isolation valve.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. An isolation seal assembly for use in a wellbore, the isolation seal assembly comprising:

a tubular with a first end and a second end and an outer tubular surface, wherein the first end is uphole of the second end;

a first latch mechanism disposed on the tubular adjacent the first end;

a first seal assembly positioned along the outer tubular surface between the first latch mechanism and the second end of tubular;

one or more openings formed along the tubular between the first latch mechanism and the first seal assembly; and a second latch mechanism positioned on the outer tubular surface between the openings and the first seal assembly, the second latch mechanism comprising one or more protrusions configured to match and engage a latch sub surrounding the tubular;

wherein the first latch mechanism comprises a shear element selected from the group consisting of a shear ring, a shear bolt, and a shear pin.

2. The isolation seal assembly of claim 1, further comprising a second seal assembly positioned along the outer tubular surface between the first seal assembly and the second end of the tubular.

3. The isolation seal assembly of claim 2, wherein the tubular includes an elongated portion between the first and second seal assemblies with the second seal assembly positioned adjacent the second end of tubular.

4. The isolation seal assembly of claim 2, wherein:

at least one of the first seal assembly and the second seal assembly comprises an elastomeric element seated in a recess formed in the outer surface of the tubular.

5. The isolation seal assembly of claim 2, wherein the one or more openings extend from an inner surface of the tubular to the outer surface of the tubular.

6. The isolation seal assembly of claim 1, further comprising a seal positioned along an inner surface of the tubular between the first latch mechanism and the openings.

7. The isolation seal assembly of claim 1, wherein the one or more openings comprise a plurality of slots.

8. The isolation seal assembly of claim 1, wherein the one or more openings comprise a plurality of perforations.

9. The isolation seal assembly of claim 1, wherein the first latch mechanism comprises a shear ring.

10. A system for placement of an engagement mechanism in a wellbore, the system comprising:

a debris removal tool; and an isolation seal assembly releasably attached to the debris removal tool, the isolation seal assembly comprising a tubular having a through bore extending between a first end and a second end, the tubular also having an outer tubular surface; a first latch mechanism disposed on the tubular adjacent the first end; a first seal assembly positioned along the outer tubular surface between the first latch mechanism and the second end of tubular; one or more openings formed along the tubular between the first latch mechanism and the first seal assembly; and a second latch mechanism positioned on the outer tubular surface between the openings and the first seal assembly, the second latch mechanism comprising one or more protrusions configured to match and engage a latch sub surrounding the tubular;

wherein the first latch mechanism comprises a shear element selected from the group consisting of a shear ring, a shear bolt, and a shear pin.

11. The system of claim 10, wherein the debris removal tool comprises a sub having jet nozzles and a head from which an elongated snorkel extends, wherein the snorkel extends beyond the second end of the anchor assembly.

12. The system of claim 11, wherein the snorkel has a snorkel length and the anchor assembly has an anchor assembly length that is shorter than the snorkel length.

13. The system of claim 10, further comprising a lower completion assembly having a packer assembly positioned at a first end of the lower completion assembly, a sand control screen spaced apart from the packer assembly; and an isolation valve disposed along a flow path defined in the lower completion assembly between the sand control screen and the packer assembly, wherein the isolation seal assembly is engaged with the lower completion assembly so that the through bore of the isolation seal assembly is in fluid communication with the flow path of the lower completion assembly.

14. The system of claim 13, wherein:

the isolation seal assembly further comprises the second latch mechanism is positioned along the tubular between the openings and the second end of the tubular; and the lower completion assembly comprises a latch sub positioned adjacent the packer assembly, wherein the second latch mechanism of the isolation seal assembly engages the latch sub of the lower completion assembly; or the lower completion assembly further comprises a closing sleeve disposed between the isolation valve and the packer assembly, wherein the closing sleeve has an elongated tubular with at least one port provided therein.

15. The system of claim 14, wherein the isolation seal assembly further comprises a second seal assembly positioned along the outer tubular surface between the first seal assembly and the second end of the tubular, and wherein the isolation seal assembly engages the lower completion assembly so that the at least one port of the closing sleeve is positioned between the first and second seal assemblies, blocking the port from fluid communication with the flow path of the lower completion assembly.

16. The system of claim 10, further comprising the second latch mechanism is positioned along the tubular between the openings and the second end.

* * * * *